United States Patent [19]

Block

[11] Patent Number: 4,835,912

[45] Date of Patent: Jun. 6, 1989

[54] ABRASIVE WHEEL

[76] Inventor: Aleck Block, 800 Warner Ave., Los Angeles, Calif. 90024

[21] Appl. No.: 126,623

[22] Filed: Nov. 30, 1987

[51] Int. Cl.[4] ..... B24B 1/00

[52] U.S. Cl. ..... 51/332; 51/331

[58] Field of Search ..... 51/330, 331, 332, 334, 51/335, 359

[56] References Cited

U.S. PATENT DOCUMENTS

| | | | |
|---|---|---|---|
| 3,872,630 | 3/1975 | Ali | 51/334 |
| 3,890,746 | 6/1975 | Saegusa et al. | 51/334 |
| 4,437,271 | 3/1984 | McAvoy | 51/359 |

*Primary Examiner*—John K. Corbin
*Assistant Examiner*—J. P. Ryan
*Attorney, Agent, or Firm*—Ellsworth R. Roston; Charles H. Schwartz

[57] ABSTRACT

A support disc preferably has an annular periphery, a central opening and a pair of substantially parallel side surfaces. Abrasive packs are disposed on the periphery of the disc in spaced relationship to one another. Each pack is formed from a stack of thin abrasive strips having abrasive particles on one surface. The packs are attached to the disc periphery with opposite ends disposed against the opposite side surfaces of the disc. The packs are preferably tilted in the direction of disc rotation so that the trailing edge of the outermost strip in each pack engages the workpiece. When the angle of tilting is large, the pack ends of the packs may be cut at an angle to facilitate an abutting relationship between adjacent disc packs. In one embodiment, the abrasive wheel is disposable. In another embodiment, only the abrasive packs on the disc (and not the disc) are disposable. In this embodiment, the packs may be bent into a horse-shoe shape and bonded to one another at their peripheries as by resin. In both embodiments, the disc and the peripherally disposed packs can be supported for rotation as by a pair of plates with center holes, each disposed against the packs at an opposite side surface of the disc. A motor arbor can be extended through the center holes of the plates and the disc. A nut attached to the arbor can retain the plates in pressed relationship against the packs on the disc for rotation of the packs against a workpiece.

19 Claims, 2 Drawing Sheets

ABRASIVE WHEEL

This invention relates to abrasive wheels having abrasive strips folded over the periphery of a disc. More particularly, this invention relates to abrasive wheels in which the strips are formed into folded packs which are disposed to provide a resilient abrasive action against a workpiece and to adapt to the contour of the workpiece, thereby enhancing the abrasive action against the workpiece. The invention also relates to abrasive packs constructed to be disposed on a disc to form an abrasive wheel. The method additionally relates to methods of forming such abrasive wheels.

Abrasive wheels have been in existence for some time. The abrasive wheels generally include a disposable disc made from a suitable material such as cardboard and abrasive strips disposed on the periphery of the disc. As the abrasive wheel is rotated, successive ones of the abrasive strips on the disposable disc rub against a surface of the workpiece to abrade such surface.

The abrasive wheels now in use have certain limitations. Generally only one strip is disposed on the periphery of the support disc. Sometimes adjacent strips are disposed on the disc in partially overlapping relationship. Since only one strip is provided at many positions, the abrasive wheels have only a limited life. Furthermore, the partially overlapping relationship between adjacent strips causes the abrading action of the strips to be relatively uneven since the partially overlapping relationship causes the periphery of the disc to have uneven surfaces. The action of the abrasive wheel is also relatively stiff (little resiliency) since the single sheet at each peripheral position on the disc is pressed against the annular periphery of the disc by the workpiece.

A considerable effort has been made over an extended period of time, and significant amounts of money have been expended in this period, to provide an abrasive wheel which will overcome the above disadvantages. In spite of such considerable efforts and significant expenditures of money, relatively little progress has been made in overcoming such disadvantages.

This invention provides an abrasive wheel which overcomes the above disadvantages. The abrasive wheel is constructed to have a long life. It provides a resilient action against a workpiece, thereby enhancing the abrading action against the workpiece. It adapts itself to the contour of the workpiece, thereby also enhancing the abrading action against the workpiece. This is particularly true when the workpiece has a somewhat irregular shape. The abrasive wheel can be manufactured reliably and inexpensively and can be easily mounted on a powered rotary member to rotate against a workpiece and provide an abrading action against the workpiece. The abrasive wheel can be disposable when the abrasive packs become worn. When the disc component of the abrasive wheel is not disposable, the abrasive packs can be separately mounted on the disc and can be separately disposable.

In one embodiment of the invention, a fixturing disc preferably has an annular periphery, a central opening and a pair of substantially parallel side surfaces. A plurality of abrasive packs is disposed on the periphery of the disc in spaced relationship to one another. Each of the abrasive packs is formed from a stack of thin flexible abrasive strips directly superimposed on one another and having abrasive particles on the radially outer surfaces of the strips.

The packs are disposed on the periphery of the disc with opposite ends disposed against and attached to the opposite side surfaces of the disc, leaving a space between the inside of the fold of the packs and the periphery of the disc. The packs are preferably tilted in the direction of rotation of the disc so that the trailing edge of the outermost strip in each pack engages the workpiece. The tilting may be provided through a wide angle. When the angle of tilting is large, the ends of the pack may be cut at an angle to facilitate mounting a maximum number of packs on the fixturing disc. In this way, the packs can be deformed by pressure against the workpiece and thus provide a resilient abrading action against the workpiece and can adapt to the configuration of the workpiece.

In one embodiment, the abrasive wheel formed by the disc and the abrasive packs on the disc is disposable. In another embodiment, the disc is not disposable and only the abrasive packs on the disc are disposable. In this embodiment, the packs may be bent into a horse-shoe shape and may be bonded to one another at their peripheries as by white vinyl glue or staples. In both embodiments, the disc and the peripherally disposed packs can be supported for rotation as by a pair of plates, each disposed against the packs at an opposite side surface of the disc. A motor arbor extends through center holes in the plates and the disc. A nut attached to the arbor can retain the plates in pressed relationship against the packs on the disc and can retain the assembly frictionally against a shoulder on the arbor for rotation of the packs against a workpiece.

Figure 1:
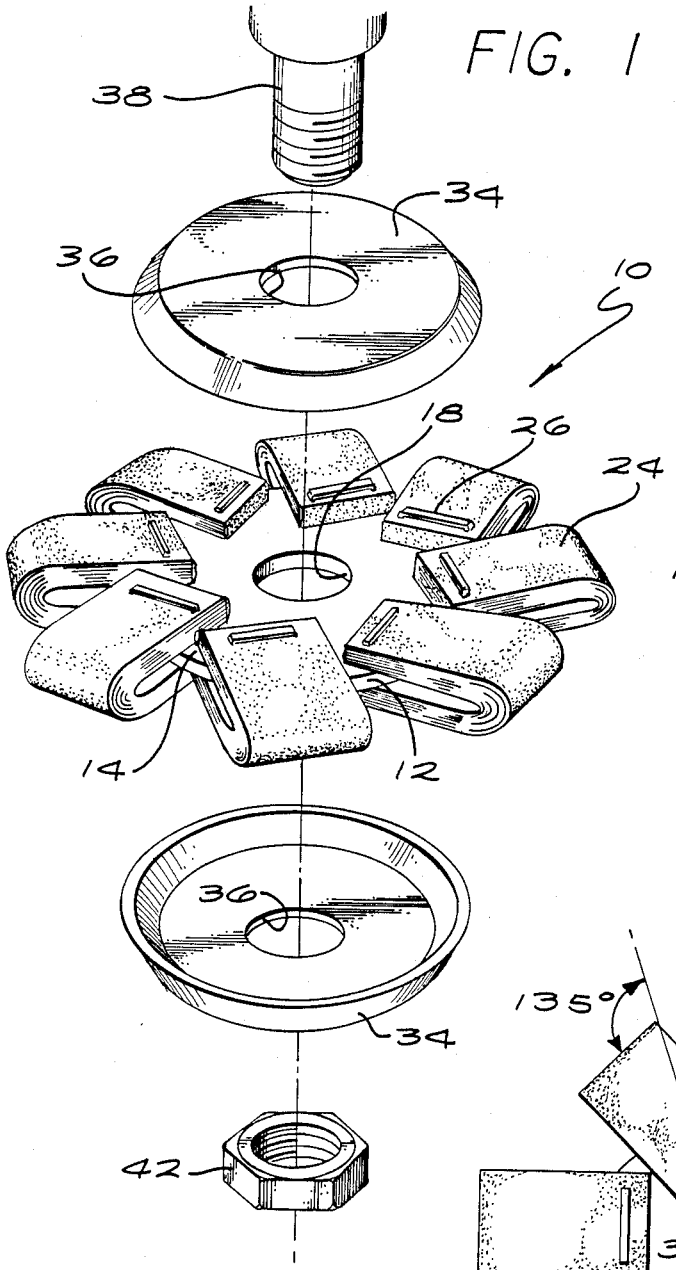
FIG. 1 is an exploded perspective view of an abrasive wheel constituting one embodiment of the invention.
Figure 3A:
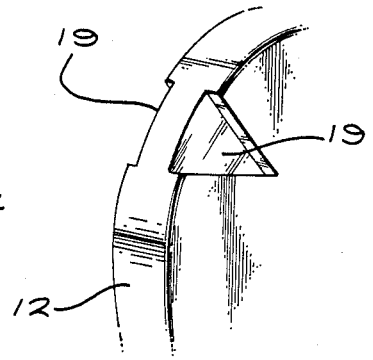
FIG. 3 is a sectional view taken substantially on the line 3—3 of FIG. 2 and illustrating the construction of one of the abrasive packs on the wheel in further detail.
Figure 3:
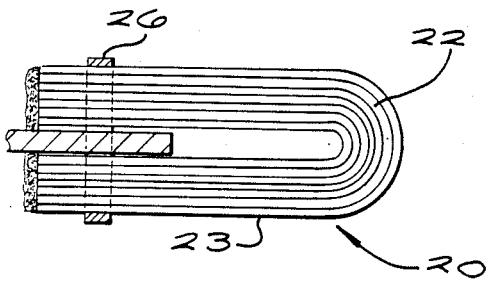
Figure 2:
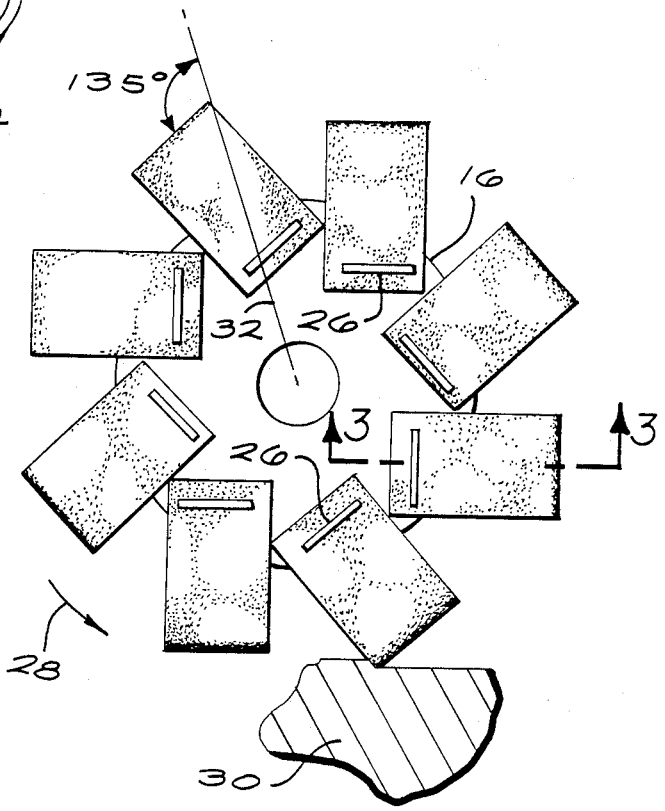
FIG. 2 is a top plan view of the abrasive wheel shown in FIG. 1 with the abrasive wheel in an assembled relationship and with an abrasive pack on the wheel disposed against a workpiece.
Figure 4:
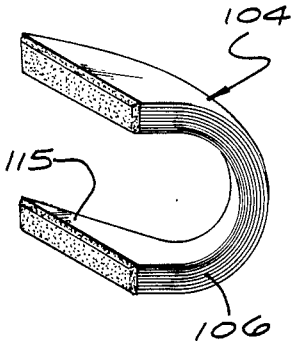
Figure 5:
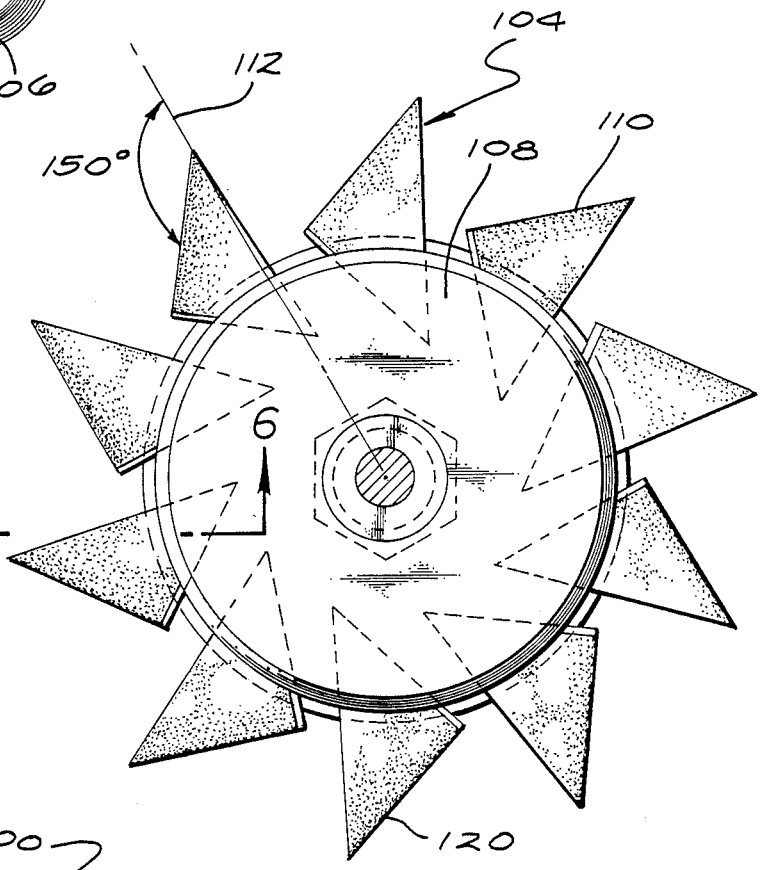
Figure 6:
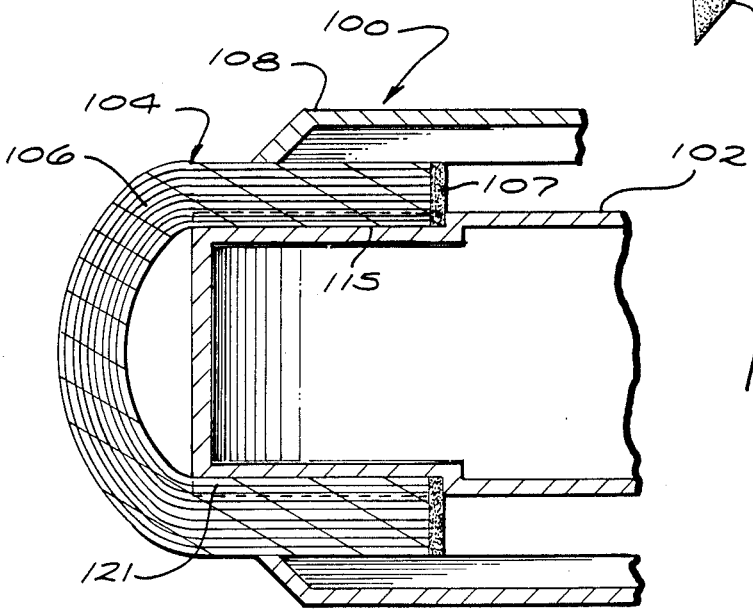

FIG. 3*a* is a fragmentary perspective view illustrating a modification in the embodiment shown in FIGS. 1–3;

FIG. 4 is a perspective view of an abrasive pack constituting another embodiment of the invention;

FIG. 5 is a top plan view of one of an abrasive wheel incorporating the packs shown in FIG. 4; and FIG. 6 is an enlarged fragmentary sectional view of the embodiment of the abrasive wheel shown in FIGS. 4 and 5 and is taken substantially on the line 6—6 of FIG. 5.

In one embodiment of the invention as shown in FIGS. 1–3, an abrasive wheel generally indicated at 10 is provided. In this embodiment, the abrasive wheel 10 includes a relatively thin support disc 12 made from a disposable material such as cardboard. The disc 12 may be relatively thin and may be provided with an annular periphery 14. For example, the thickness of the disc 12 may be approximately one eighth of an inch ($\frac{1}{8}''$) and the diameter of the disc may be approximately four inches (4″). It will be appreciated, however, that any other thickness and diameter may be provided for the disc 12. The disc 12 is preferably provided with substantially parallel and planar sides 16 and with a central opening 18. The disc 12 may be provided with equally spaced indentations 19 on its sides for precisely locating replaceable packs of abrasive sheets. This is shown in FIG. 3*a*.

In the embodiment of the invention as shown in FIGS. 1–3, a plurality of abrasive packs generally indicated at 20 are disposed on the annular periphery 14 of the disc 12. Each of the abrasive pack 20 is formed from a plurality of abrasive strips 22. Each of the abrasive strips 22 is formed from a thin sheet (or thin sheets) of a resilient material in a conventional manner and is provided with abrasive particles 24 on one side of the strip. The abrasive strips are stacked in each of the abrasive packs 20 in the same relationship. In this relationship, the abrasive strips 22 face outwardly from the disc 12. By way of illustration, the abrasive strips may have a length of approximately four inches (4") and a width of approximately one inch (1"). However, any other practical width or length may be provided for the abrasive strips.

The abrasive strips 22 in each pack 20 are disposed at an intermediate position against the annular periphery 14 of the support disc 12 in the embodiment shown in FIGS. 1—3. The ends of the strips 22 in each pack 20 are then bent against the sides 14 of the disc 12. The strips 22 in each pack 20 may be retained in this relationship by suitable fastening means such as a staple 26. The staple 26 extends through the ends of the strips 22 in each pack 20 and through the disc 12 and are folded against the strips in the packs at their free ends.

The strips 22 in each pack 20 are tilted in the direction of rotation of the disc 12. This direction is indicated by an arrow 28 in FIG. 2. In this way, only the trailing end of the outermost strip 22 in each pack 20 engages a workpiece 30 as the disc 12 rotates. In the embodiment shown in FIGS. 1—3, the median positions of the strips 22 in each pack 20 are tilted forwardly and downwardly at a suitable angle such as an angle of 135° relative to a radial line, such as a line 32, extending from the center of the disc to the trailing tip of such strips on the pack. It will be appreciated, however, that other angles may also be chosen, providing such angles are more than 90° to radial line 32.

Plates 34 having centrally disposed holes 36 are disposed against the side surfaces of the packs 12 to support and retain the packs. Preferably the plates are made from a suitable metal such as steel and are pan-shaped. Preferably the plates 34 are disposed so that they engage the strips 22 in each pack 20 at a position where the strips are disposed against the sides 14 of the disc as by the staples 26. In this way, the plates 34 support the packs 20 in fixed relationship to one another as the plates 34 rotate. A shaft 38 extends through the holes 36 in the plates 34 and the central opening 18 in the disc 12. The shaft 38 is threaded as at 40 and a nut 42 is threaded on the shaft 38 to press the plates 34 against the abrasive packs 20 on the disc 12.

When the disc 12 in the embodiment shown in FIGS. 1—3 is rotated, the trailing ends of the outermost strips 22 on the packs 20 rub against the surface of the workpiece 30 and abrade this surface. Since each of the packs 20 is formed from a plurality of the strips 22, each pack is somewhat resilient when it engages the workpiece 30. This causes the action of the strips 22 against the surface of the workpiece 30 to be somewhat cushioned. However, the action of the strips 22 against the surface of the workpiece 30 is somewhat solid and forceful because each of the strips is reinforced by the adjacent strips in the pack 20. This resilient but solid action against the workpiece facilitates the abrading action of the packs 20 against the workpiece 30.

Since each pack 20 is somewhat displaced from the periphery 14 of the disc 12, it tends to be flattened as it engages the workpiece 30. In this way, the shape of the pack 20 is adjusted to conform to the contour of the workpiece 30. This facilitates the abrading action of each pack 20 on the workpiece 30. Even though the shape of each pack 20 is adaptable to conform to the contour of the surface to be abraded on the workpiece 30, the pack still has considerable body because it is formed from a plurality of stacked strips 22. This facilitates the solid action of the packs against the workpiece 30 as discussed in the previous paragraph. Because of this, an efficient and reliable abrading action is provided against the full area of the workpiece surface which is contacted by the pack.

As the abrasive wheel 10 continues to be used to abrade the surface of the workpiece 30, the outermost strip 22 on each pack will wear away at the trailing end of the pack. This will expose the abrasive surface on the next strips 22 in each pack 20 as the trailing ends of the successive strips in the packs become worn away. Even as the successive strips 22 in each pack 20 become exposed to provide an abrasive action, the abrasive wheel 10 will continue to provide an abrading action on the surface of the workpiece 30 with all of the advantages discussed in the previous paragraphs. This results from the disposition of a number of the strips 22 in each pack 20 and from the tilted disposition of the packs relative to the disc 12.

When the abrasive strips 22 in the packs 20 become worn, the nut 42 is removed from the shaft 38, and the plates 34 and the wheel 10 are removed from the shaft 38. The worn unit of the abrasive wheel 10 is removed, and another unit of the abrasive wheel 10 is disposed between the plates 34. The shaft 38 is then inserted through the holes 36 in the plates 34 and through the central opening in the disc 12. The nut 42 is then screwed on the shaft 38 until the plates 34 are pressed against the sides of the abrasive packs 20. The abrading action against the surface of the workpiece 30 can then be resumed.

FIGS. 4, 5 and 6 illustrate an embodiment generally illustrated at 100 and having a non-disposable disc 102 and a plurality of abrasive packs, generally indicated at 104, disposed on the periphery of the disc. The disc 102 may be made from a suitable material such as firm rubber and is adapted to be used repeatedly. The abrasive packs 104 may be formed from a plurality of abrasive strips 106 each constructed in a manner similar to that described above for the strips 22 in the embodiment shown in FIGS. 1—3.

The abrasive packs 104 may be preformed to have a horse-shoe (or "C") shaped configuration. The ends of the strips 106 in each pack 104 may be peripherally adhered to one another at their opposite ends by a suitable adhesive 107 such as an epoxy. The ends of each pack 104 may be adhered to the disc 102 by a pressure sensitive adhesive 115 until they can be compressed against and retained on the disc by plates 108 corresponding to the plates 34 shown in the embodiment of FIGS. 1—3. The packs 104 are forwardly tilted on the disc 102 in a manner similar to that described above for the embodiment shown in FIGS. 1—3.

Although the packs 104 are adhered at their ends in the area adjacent the side surfaces of the disc 102, the portions of the packs acting on a workpiece such as the workpiece 30 do not have any adhering material. The packs 104 are thus able to operate effectively and flexibly in abrading the surface of the workpiece 30. When the abrasive packs 104 on the disc 102 have become worn by application against a work surface such as the work surface 30, the packs can be removed from the disc and replaced by fresh packs. Indentations such as the indentations 19 in FIG. 3*a* in the sides of the disc 121 may assist the operator in evenly spacing the packs on the disc.

In order to increase the number of packs 104 on the peripheral surface of the disc 102, the packs 104 may be tilted at a greater angle than 135° as in the embodiment shown in FIGS. 1—3. For example, an angle as great as 150° may be provided between a working surface 110 on each pack 104 and a radius 112 through the trailing tip of the pack. In order to facilitate the close spacing between adjacent packs 104 on the disc 102 and to maximize the number of packs on the disc, an oblique cut 114 may be made between the radially inward end of the pack 104 and the trailing tip of the pack, thus forming the sides of the packs 120 into triangular shapes.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination in an abrasive wheel, a support disc having a central opening and a periphery and having opposite side surfaces and having substantially a planar configuration, a plurality of abrasive packs each formed from a plurality of abrasive sheets disposed in stacked relationship, each of the sheets being thin and having opposite surfaces and having one of the surfaces facing outwardly and having abrasive particles on its outwardly facing surfaces, the abrasive packs being disposed in spaced relationship to one another on the periphery of the support disc and being bent into a horseshoe shape against the opposite side surfaces of the support disc at a position between the central opening and the periphery of the support disc, and fastening means extending through the opposite ends of the abrasive packs and the support disc to hold the abrasive packs in fixed relationship on the support disc.

2. In a combination as set forth in claim 1, the abrasive packs being disposed at an angle to the radius extending from the center of the disc to the periphery of the disc at an intermediate position along the peripheral length of the packs on the support disc.

3. In a combination as set forth in claim 1, the abrasive packs being tilted downwardly relative to the periphery of the support disc in the direction of rotation of the support disc.

4. In a combination as set forth in claim 1, the abrasive packs being tilted downwardly at an angle in the range of approximately 15° to approximately 60°, in the direction of rotation of the abrasive wheel, relative to a radius extending from the center of the disc to the forward tip of the packs on the support disc.

5. In combination in an abrasive wheel for abrading workpieces, a disposable support disc having an annular periphery and a pair of closely spaced planar surfaces defining the thickness of the disc, a plurality of packs disposed on the support disc in spaced relationship to one another around the periphery of the disc, each of the packs being formed from a plurality of abrasive sheets disposed in a stacked relationship, each of the abrasive sheets having first and second opposite surfaces, the first surface of each sheet facing outwardly, there being abrasive particles on the first surface of each sheet, each of the packs being disposed on the periphery of the support disc with one end disposed against one of the surfaces of the discs and the other end disposed against the other surface of the disc, each of the packs being disposed relative to the periphery of the disc to engage the workpiece at the trailing ends of the packs in the direction of rotation of the disc, and means for attaching the opposite ends of each pack to the opposite surfaces of the disc.

6. In a combination as set forth in claim 5, the support disc being made from cardboard and the attaching means for the packs constituting staples.

7. In a combination as set forth in claim 5, each of the abrasive packs being tilted forwardly and downwardly in the direction of rotation at an acute angle relative to a radius extending from the center of the disc to the forward tip of such abrasive pack on the disc.

8. In a combination as set forth in claim 7, the acute angle defined by each abrasive pack relative to such radius having a range between approximately 15° and approximately 60°.

9. In combination for abrading a workpiece, a support disc made from a disposable material and having a central opening and a periphery and a pair of substantially parallel and closely spaced side surfaces, a plurality of abrasive packs each formed from a plurality of abrasive strips disposed in a stacked relationship, each of the abrasive strips having a pair of substantially parallel and closely spaced surfaces, one of the surfaces on each strip facing outwardly and having abrasive particles on such surface, each of the abrasive packs being disposed on the periphery of the support disc at an intermediate position along the length of the pack and opposite ends of such pack being disposed against the opposite side surfaces of the disc, the packs being displaced relative to the adjacent packs on the periphery of the support disc, means extending through the opposite ends of the abrasive packs and the support disc for supporting the abrasive packs on the support disc, and means disposed against the opposite side surfaces of the support disc and extending through the central opening in the support disc for supporting the support disc for rotation against the workpiece.

10. In a combination as set forth in claim 9, the disc-support means including a pair of plates each disposed against the packs at an individual one of the side surfaces in the support disc and further including means centrally disposed relative to the support disc and the plates for holding the plates in pressed relationship against the packs at the opposite side surfaces of the support disc.

11. In a combination as set forth in claim 9, each of the abrasive packs being tilted forwardly and downwardly on the periphery of the support disc in the direction of rotation of the support disc to provide for an engagement of the workpiece by the trailing edge of such abrasive pack during the rotation of the support disc and the disc-support means.

12. In a combination as set forth in claim 10, each of the abrasive packs being tilted forwardly and downwardly on the periphery of the support disc in the direction of rotation of the support disc to provide for an engagement of the workpiece by the trailing edge of such abrasive pack during the rotation of the support disc and the disc-support means, such tilting being at an angle in the range of approximately 125° to approximately 155° relative to a radius extending from the center of the disc through the trailing tip of the abrasive pack on the periphery of the support disc.

13. In combination for use with a disc in an abrasive wheel where the disc has substantially planar surfaces, a pack made from a plurality of stacked strips each having abrasive material on one surface and each bent into a substantially horseshoe shape, the strips in the abrasive pack being disposed with the abrasive material facing outwardly, the abrasive strips being peripherally adhered to one another at their opposite ends for disposition of the opposite ends against the substantially planar surfaces of the disc.

14. In a combination as set forth in claim 13 wherein the pack is adapted to be applied against a workpiece, the pack being solid and resilient and having properties of flattening at the curved portion between the opposite ends of the horse-shoe configuration when the pack is applied against the workpiece.

15. In a combination as set forth in claim 14, the strips having substantially a rectangular configuration with an oblique cut at the opposite ends of the strips.

16. In a combination as set forth in claim 13, the strips having substantially a triangular configuration.

17. In combination for use with a disc in an abrasive wheel where the disc has substantially planar surfaces, a pack made from a plurality of stacked abrasive strips each bent into a substantially horseshoe configuration and having abrasive material on a first surface of the disc, all of the first surfaces of the strips facing in the same direction, and adhering material between the strips at the peripheries of the strips to unitize the strips in the pack and to provide for the deposition of the pack against the substantially planar surfaces of the disc.

18. In a combination as set forth in claim 17, the opposite ends of the pack being bent toward each other for disposition on the disc with the central portion of the pack on the periphery of the disc and the extremities of the pack facing the opposite surfaces of the disc.

19. In a combination as set forth in claim 18, the opposite ends of the pack being cut to provide oblique peripheries at the opposite ends.

* * * * *